United States Patent [19]

Harz et al.

[11] Patent Number: 4,806,715

[45] Date of Patent: Feb. 21, 1989

[54] TENSIONING DEVICE FOR THE DRIVING SPRING OF AN ENERGY STORE FOR ELECTRICAL SWITCHES

[75] Inventors: Gerhard Harz, Regensburg; Erwin Reichl, Tegernheim, both of Fed. Rep. of Germany

[73] Assignee: Sachsenwerk Aktiengesellschaft, Regensburg, Fed. Rep. of Germany

[21] Appl. No.: 71,828

[22] Filed: Jul. 10, 1987

[30] Foreign Application Priority Data

Jul. 10, 1986 [DE] Fed. Rep. of Germany ..... 3623247

[51] Int. Cl.[4] ..... H01H 3/02

[52] U.S. Cl. ..... 200/400

[58] Field of Search ..... 200/17 R, 18, 153 SC; 335/76

[56] References Cited

U.S. PATENT DOCUMENTS 4,409,449 10/1983 Takano et al. ..... 200/153 SC
4,655,098 4/1987 Marquardt et al. ..... 200/153 SC

FOREIGN PATENT DOCUMENTS 1814086 6/1960 Fed. Rep. of Germany .
1490720 12/1969 Fed. Rep. of Germany .
6605397 1/1970 Fed. Rep. of Germany .
1655936 8/1972 Fed. Rep. of Germany .
3114727A1 10/1982 Fed. Rep. of Germany .
3131903 2/1983 Fed. Rep. of Germany .

OTHER PUBLICATIONS

AEG, Sachsenwerk, Operating Instructions Manual "Three-Pole Vacuum Circuit Breaker Type VA with One Vacuum Bottle for Each Breaker Pole"; No. 531,171, May, 1986.

*Primary Examiner*—J. R. Scott
*Attorney, Agent, or Firm*—Spencer & Frank

[57] ABSTRACT

Tensioning device for a driving spring of an energy store for an electrical switch, the device including: a drive shaft carrying a crank articulated to the driving spring; a rotatable tensioning shaft; mechanism connected for rotating the tensioning shaft; at least one overrunning clutch coupled to the drive shaft; and a transmission mechanism connected between the tensioning shaft and the drive shaft for imparting at least one unidirectional stepwise rotational advance to the drive shaft with each revolution of the tensioning shaft, wherein the tensioning shaft and the transmission shaft have respective axes of rotation which are nonparallel to one another.

18 Claims, 7 Drawing Sheets

TENSIONING DEVICE FOR THE DRIVING SPRING OF AN ENERGY STORE FOR ELECTRICAL SWITCHES

BACKGROUND OF THE INVENTION

The present invention relates to a tensioning device for the driving spring of an energy store for electrical switches.

Such a device is used, for example, to operate circuit breakers, such as the type VA three-pole vacuum circuitbreaker manufactured by Sachenwerk Aktiengesellschaft, Federal Republic of Germany.

Various configurations are known for tensioning devices of this type. Compared to other step-down gear assemblies with form-locking transmission elements, such as toothed gear and worm drives, they utilize the high efficiency and small dimensions of overrunning clutches. Compared to charging means operating with ratchet wheels and pawls, they have the advantage of operating free of jolts independently of the tooth pitch and thus keep intermittent stresses away from the transmission members.

A tensioning device of this type is disclosed in the Federal Republic of German patent document No. 1,490,720 in which motion is transferred between parallel shafts by way of eccentrics and driving levers which rest against them under spring pressure. The drive motor is here connected with the shaft supporting the eccentric by means of a V-belt drive.

A prior art tensioning device is also shown the Federal Republic of German patent document No. 1,665,936 as an arrangement equipped with two overrunning clutches and associated eccentrics for a switch drive including a spring drum.

Finally, the Federal Republic of Germany patent document No. 3,131,903 discloses an electromotor drive in which the known transmission elements are also employed.

The prior art drives have in common that the axis of the motor and possibly also the axis of a hand crank that can be attached, preferably for emergency operation, lie parallel to the axis of the shaft on which acts the drive spring for the switch. However, for switches installed in small-volume, encapsulated switching systems as so-called front switches, it is required that all manipulations necessary for operation be made at the side of the energy store housing opposite the switching poles and that the energy store housing have the smallest possible dimensions.

SUMMARY OF THE INVENTION

It is an object of the present invention to provide a tensioning device of the above-mentioned type whose dimensions are brought to a minimum and which can be operated with the smallest amount of effort from the side of the energy store housing opposite the switching poles.

The above and other objects are achieved, according to the invention, by a tensioning device for a driving spring of an energy store for an electrical switch, which device includes: a drive shaft carrying a crank articulated to the driving spring; a rotatable tensioning shaft; means connected for rotating the tensioning shaft; at least one overrunning clutch coupled to the drive shaft; and transmission means connected between the tensioning shaft and drive shaft for imparting at least one unidirectional step-wise rotational advance to the drive shaft with each revolution of the tensioning shaft, wherein the tensioning shaft and the transmission shaft have respective axes of rotation which are nonparallel to one another.

The tensioning device according to the invention permits the creation of particularly compact, small-volume energy stores for low voltage and medium voltage switches. These may be energy stores for intermittent drives as well as, in conjunction with a turn-on lock, energy stores for storage drives. The features of the present invention make it possible to arrange the motor for the tensioning device in such a manner that it takes up space in the width dimension of the housing of the energy store corresponding only to its diameter while its usually significantly greater length is accommodated in the depth direction of the housing without the housing dimension in this direction having to be enlarged for this purpose. It thus becomes easier to install and remove the device if there is damage to the motor. Moreover, without the use of an additional reversing gear, the crank for emergency manual operation can be pushed onto the tensioning shaft at the front of the housing.

The invention can be used to advantage for all switching devices used in narrow, metal encapsulated switching systems, particularly for systems employing pressurized gas insulation in which usually the drives for the three-position switches and their locking devices are accommodated in one housing together with the energy store for the power switch. In the past, tensioning devices employing worm gears or, for example, reversing drives composed of bevel gears were used for this purpose.

Various embodiments of the invention will be described in greater detail below with reference to the drawing.

DESCRIPTION OF THE PREFERRED EMBODIMENTS

Figure 1:
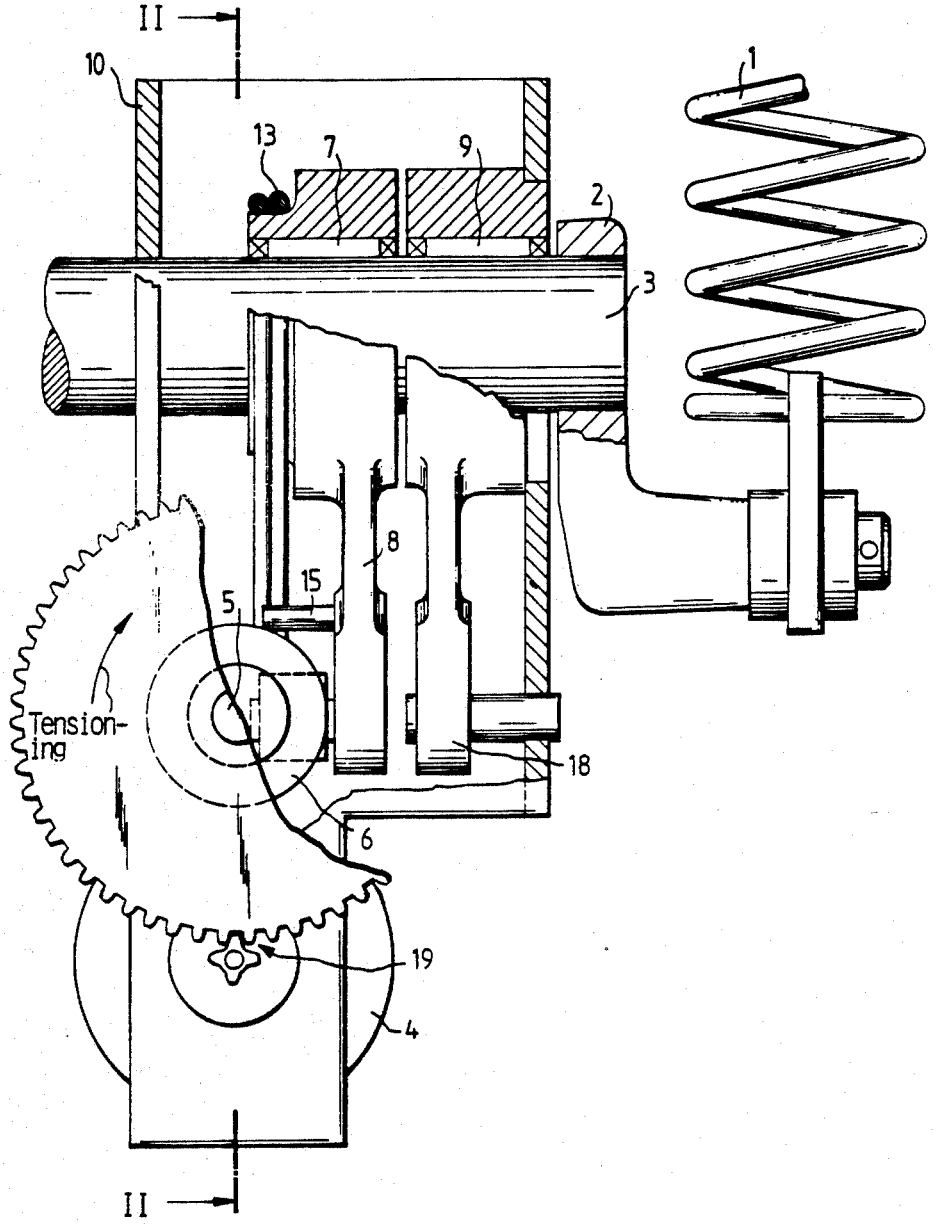
FIG. 1 is a front view, partly in cross section, of a tensioning device according to one preferred embodiment of the invention with crossed shafts and with the driving spring in the tensioned position.

FIG. 1 shows a tensioning device having a driving spring 1 which is shown in its tensioned position. Spring 1 is articulated to crank 2. Also shown is a revolving drive shaft 3 and tensioning components, while the driven end of shaft 3 toward the switching poles is not shown since it is not considered to be relevant to an understanding of the present invention. These parts would follow on an extension of drive shaft 3 to the left.

Figure 2:
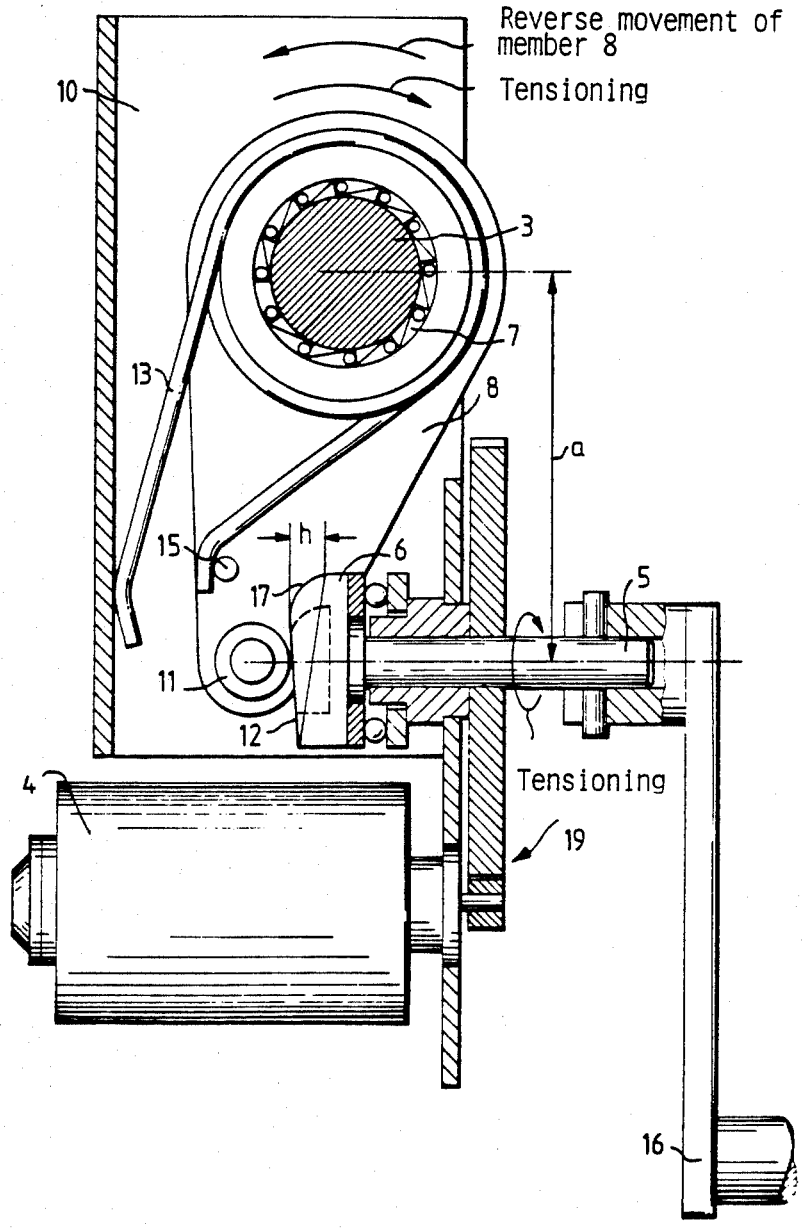
FIG. 2 is a cross-sectional view along line II—II of FIG. 1.

FIG. 2 shows the motor 4 which causes tensioning shaft 5 to rotate clockwise, in the plane of FIG. 1, for example by way of a backgear 19. The axis of shaft 5 lies in a plane perpendicular to the axis of shaft 3. In order to tension driving spring 1, this rotary movement of shaft 5 is transferred by a cam cylinder 6, which has an external camming edge, and by way of a driving lever 8 which transmits stepped advances to an overrunning clutch 7, to rotate drive shaft 3 clockwise with respect to the plane of FIG. 2. A roller 11 which is rotatably attached to driving lever 8 then rolls along cam track 12 of cam cylinder 6. One tensioning step here corresponds to the height range h of cam cylinder 6, corresponding to the length of the travel path of roller 11. A spring 13 interposed between housing 10 and a pin 15 fastened on driving lever 8 then causes driving lever 8 to remain in engagement with cam cylinder 6 during the reverse movement as well.

To be able to operate drive motor 4 with the smallest possible power, cam track 12 is configured in such a manner that the portion of cam track 12 which effects tensioning step h, i.e. displacement of roller 11 to the left in FIG. 2, has a relatively shallow rise and extends over almost the entire track circumference, while a comparatively steep unrolling flank 17 is provided for the return movement of driving lever 8. During this return movement, a second overrunning clutch 9 whose outer ring is fixed to housing 10 by means of a second lever 18, or some other block, prevents rotation of drive shaft 3 in the reverse direction. In this embodiment, the spacing a between the axes of shafts 3 and 5 is approximately equal to the effective lever arm of driving lever 8.

FIG. 2 also shows a hand crank 16 which is used to tension driving spring 1 if there is no actuating voltage.

The following Figures illustrate further embodiments of the actual drive for the overrunning clutches.

Figure 3:
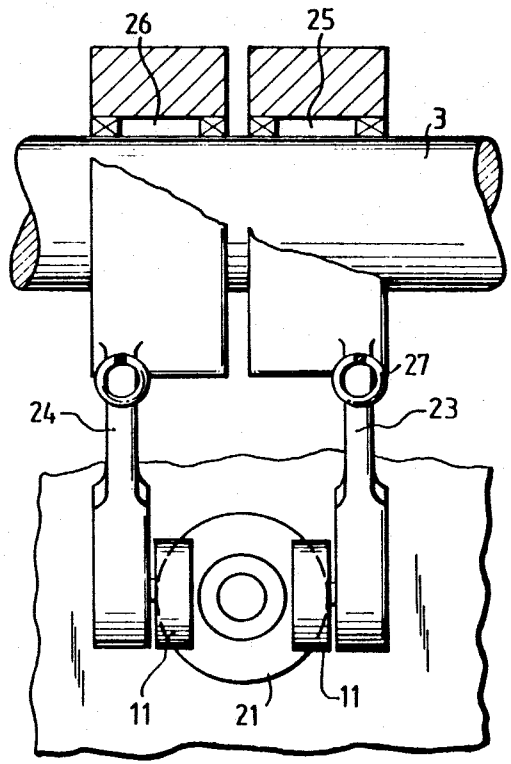
FIG. 3 is a front view of the overrunning clutch drive with crossed shafts and two effective overrunning clutches.
Figure 4:
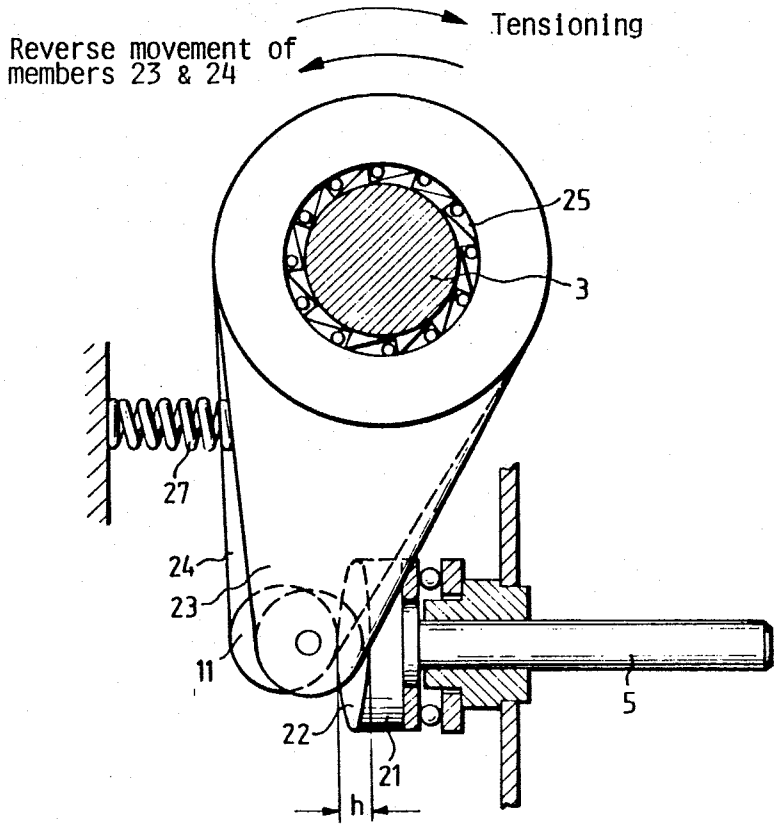
FIG. 4 is a side view of FIG. 3.

An advantageous modification of the invention is shown in FIGS. 3 and 4. The tensioning movement is here transferred from tensioning shaft 5, by means of a cam cylinder 21 whose camming track 22 is configured, for example, as a sectional plane oblique to the axis of cylinder 21, to two driving levers 23, 24 resting against track 22 at two diametrically opposite sides thereof via crowned rollers 11 and the tensioning movement is then transferred from driving levers 23, 24 by way of overrunning clutches 25, 26 in steps and clockwise, with respect to the plane of FIG. 4, to drive shaft 3.

In the position illustrated, the driving lever 24, at the left in FIG. 3, has reached the highest position on cam track 22 and has thus completed a tensioning step, while the right driving lever has simultaneously reached the lowest position at the end of its reverse movement or idle stroke. During further rotation of tensioning shaft 5, driving lever 23 runs up on track 22 to execute the next tensioning step via overrunning clutch 25, while a spring 27 simultaneously takes care of the return movement of driving lever 24 with its overrunning clutch 26 disengaged. Each lever 23, 24 is associated with a respective spring 27. The displacement path h of track 22 corresponds to one tensioning step. Otherwise the tensioning device operates in the same manner as described in connection with FIGS. 1 and 2, with, however, two tensioning steps being transmitted per revolution of tensioning shaft 5 and, similarly to the prior art driving device disclosed in FRG-OS No. 1,490,720, no additional measures are needed to prevent return rotation of drive shaft 3.

Figure 6:
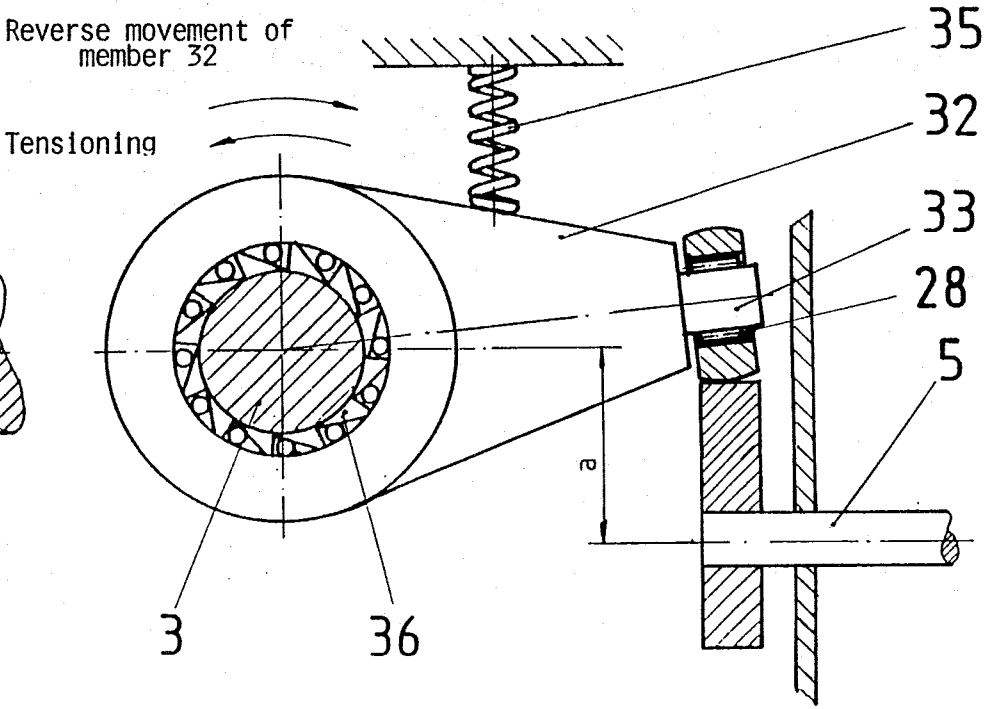
FIG. 6 is a side view of FIG. 5.
Figure 5:
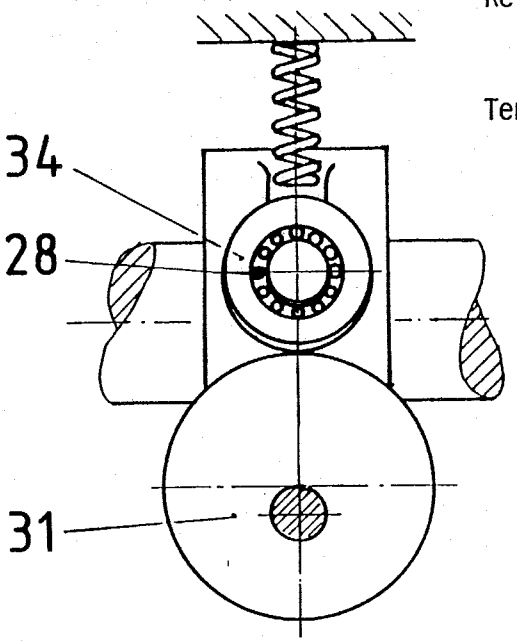
FIG. 5 is a front view of the overrunning clutch drive with crossed shafts and a comparatively small spacing a between axes.

FIGS. 5 and 6 show a particularly simple transmission device for the tensioning movement in which the following features are different.

A planar eccentric cam disc 31 fastened on tensioning shaft 5 cooperates with a roller 34 disposed on a driving lever 32 of an overrunning clutch 36, with the axis 33 of roller 34 being perpendicular to drive shaft 3. Roller 34 has a crowned outline so as to provide, under the force of a return spring 35, the same defined contact with cam disc 31 in any position during its revolution. In its center position, driving lever 32 takes on a position which is approximately parallel to the center line of tensioning shaft 5, with the axial spacing a between the crossed shafts 3 and 5 being comparatively small. The above-described structure can preferably be used in switches in which the housings of energy stores must be particularly small in width as well as in height.

Figure 8:
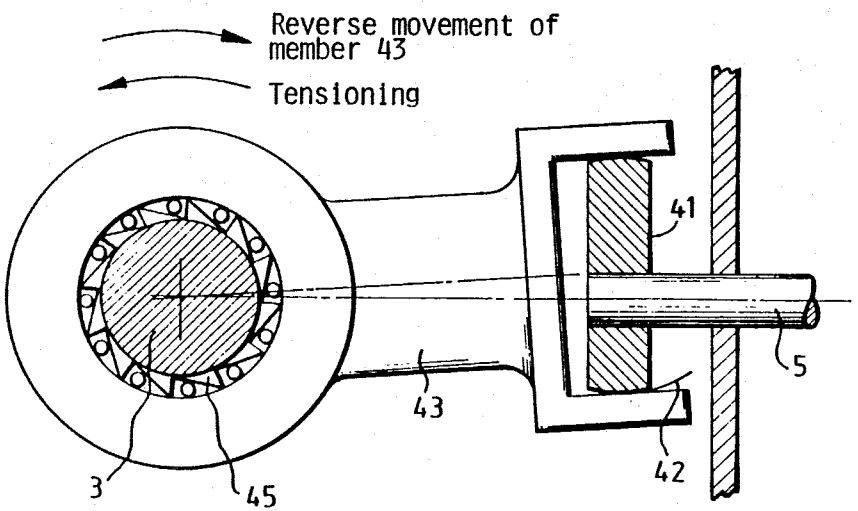
FIG. 8 is a side view of FIG. 7.
Figure 7:
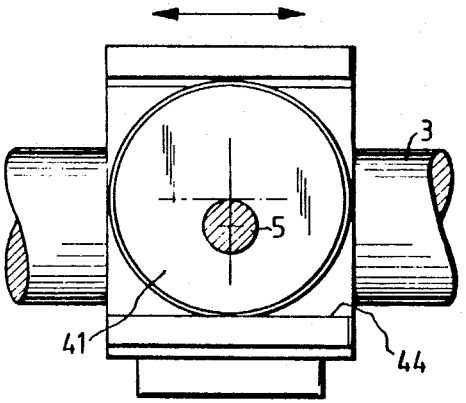
FIG. 7 is a front view of the overrunning clutch drive with intersecting shafts and a spherical joint.

A further improvement in terms of low structural height of the housing of energy stores is provided by an embodiment in which shafts 3 and 5 intersect, one structural example of which is shown in FIGS. 7 and 8.

An eccentric disc-shaped body 41 which terminates charging shaft 5 is crowned with a preferably spherical track 42 that is guided together with a slot 44 attached to a driving lever 43 axially parallel to drive shaft 3 so that one-half of a revolution of tensioning shaft 5 moves body 41 out of the illustrated upper dead center position into the lower dead center position and thus performs an oscillating relative movement in slot or groove 44 as shown by the arrow in FIG. 7.

The arrows refer to the relative movement of the center point of the disc-shaped body 41 within slot 44.

When the lower dead center position is reached, the reverse movement of driving lever 43 is completed; during the next one-half revolution, a tensioning step is performed.

Figure 10:
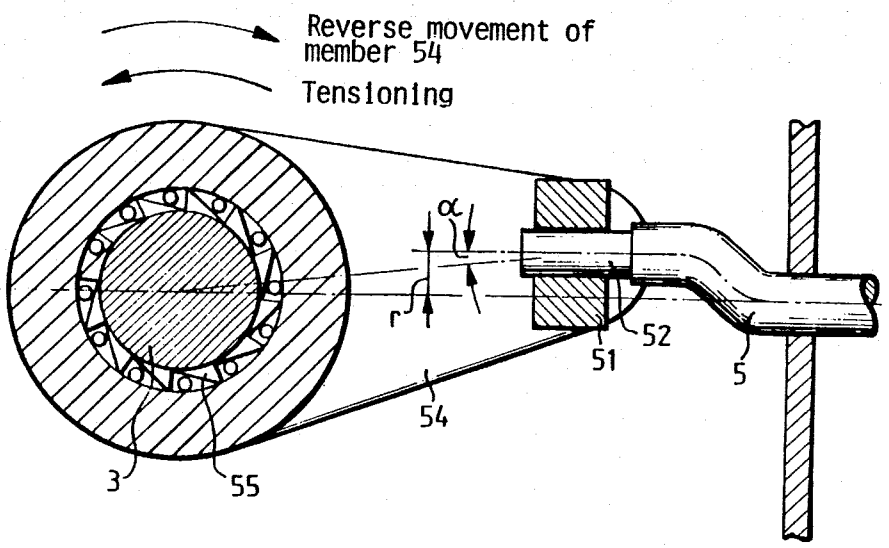
FIG. 10 is a cross-sectional view along line X—X of FIG. 9.
Figure 9:
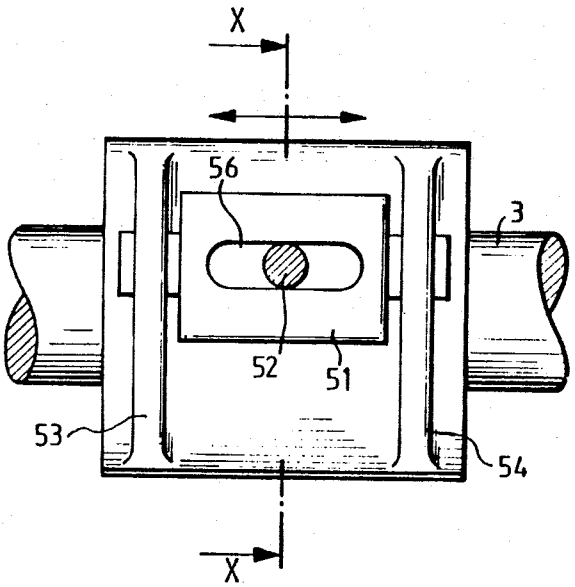
FIG. 9 is a front view of the overrunning clutch drive with intersecting shafts and employing an articulated connection.

FIGS. 9 and 10 show a further advantageous embodiment for the smallest space requirements which employs an articulated drive.

Crank pin 52 which is attached eccentrically to tensioning shaft 5 is guided in a groove 56 of an articulated member 51, with the latter being pivotally mounted in a fork member 53 that terminates a driving lever 54. In the illustrated position, crank pin 52 is in the upper dead center position and has thus completed one tensioning step via overrunning clutch 55. The next one-half revolution of tensioning shaft 5 causes driving lever 54 to reverse direction. During this movement, crank pin 52 performs an oscillating relative movement in groove 56 in the direction of the arrow in FIG. 9, while articulated member 51 simultaneously is pivoted in forked member 53 over an angle $2\alpha$. The length of groove 56 must be at least twice the value of the eccentricity r of pin 52.

Figure 11:
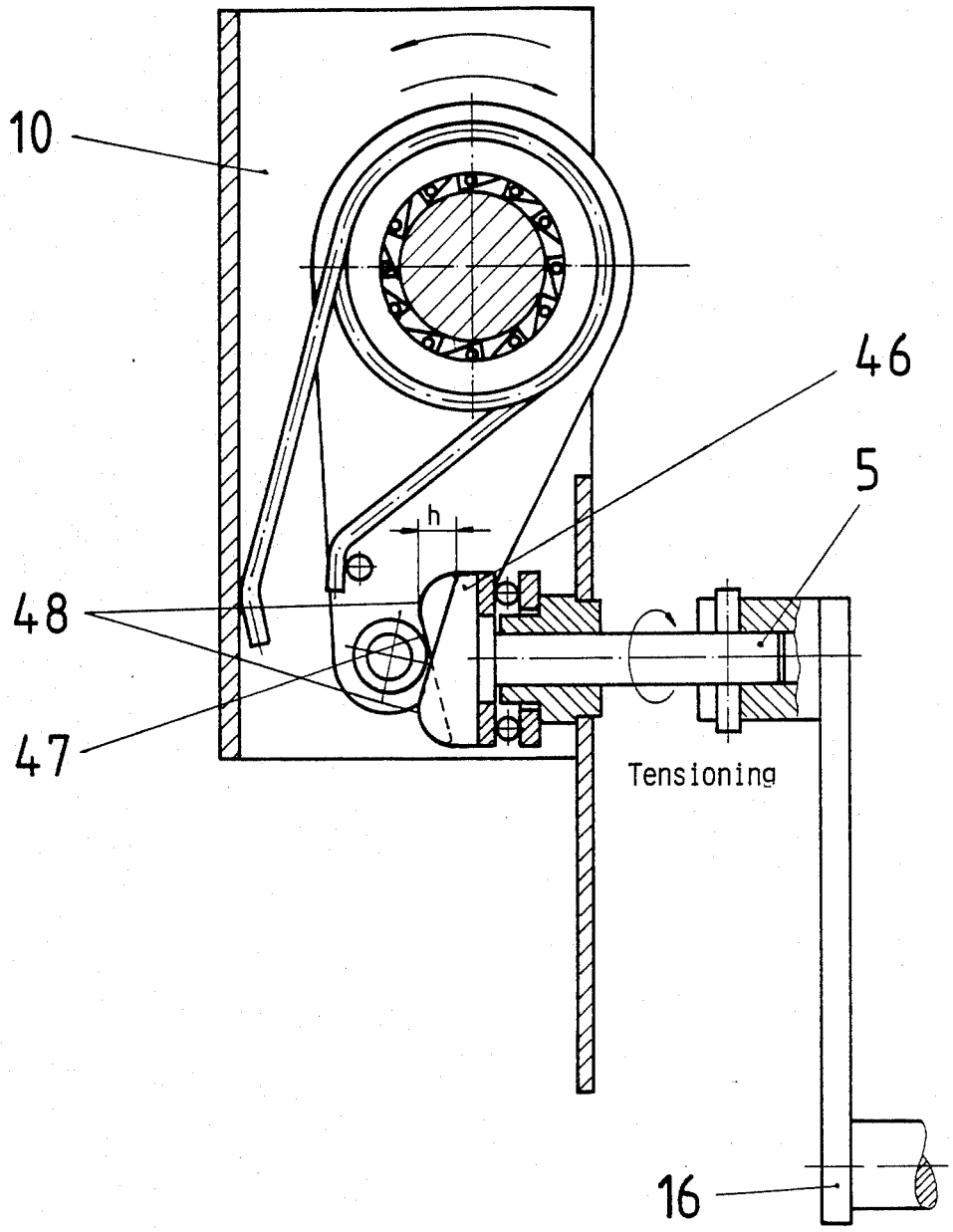
FIG. 11 is a sectional view along line II—II of FIG. 1 for a tensioning device with hand crank, without motor.

FIG. 11 shows a tensioning device including a cam cylinder 46 whose cam paths include two vertexes 48 separated from one another by about 180° with a difference in height h between them and identically shaped curved sections 47 disposed therebetween. With this embodiment it is possible to shorten the tensioning period which is particularly desirable for drives not having a motor drive and in which the drive spring is tensioned by means of a hand crank 16. FIG. 11 otherwise corresponds in function to FIG. 2. Instead of two, it is possible to provide three or more identically shaped sections.

To reduce friction and increase mechanical service life, the rollers, e.g. roller 34 in FIGS. 5 and 6, may be equipped with a roller bearing 28.

Spring 1 may be a tension or compression spring of which one end is attached to crank 2 and the other end is stationary, i.e. attached to housing 10. FIG. 1 shows a tension spring at its dead center position, in its tensioned position; the switch is "ready to switch". After passing over dead center, drive spring 1 then turns drive shaft 3 180° clockwise (FIG. 2), thus causing the switch to perform a "turn-on"; this customarily tensions further springs to switch off. In the vicinity of the now reached second dead center of drive shaft 3, the drive comes to a stop. A new process of tensioning drive spring 1 can now be performed by means of the tensioning device according to the invention.

According to FIG. 1, drive shaft 3 is connected, on its left side, directly with the other parts of the switch drive. The tensioning of drive spring 1 can be effected either by way of a motor 4 or by way of a hand crank 16 attached when needed. The latter occurs particularly if the electrical switch is not equipped with a motor.

It will be understood that the above description of the present invention is susceptible to various modifications, changes and adaptations, and the same are intended to be comprehended within the meaning and range of equivalents of the appended claims.

What is claimed:

1. Tensioning device for a driving spring of an energy store for an electrical switch, said device comprising:

a housing;

a drive shaft rotatably mounted to said housing and carrying a rank articulated to the driving spring;

a tensioning shaft rotatably mounted to said housing;

means connected for rotating said tensioning shaft;

an overrunning clutch coupled to said drive shaft;

transmission means connected between said tensioning shaft and said overrunning clutch for imparting at least one unidirectional step-wise rotational advance to said drive shaft with each revolution of said tensioning shaft, said transmission means imparting rotation to said drive shaft through said clutch, said transmission means comprising a cam mechanism including a cam member including a camming track and a follower member including a driver lever engaging said camming track; said cam member being connected to said tensioning shaft and said follower member being connected to said overrunning clutch, whereby rotation of said tensioning shaft causes rotation of said cam member and oscillation of said follower member for moving said overrunning clutch thereby imparting unidirectional step-wise rotation to said drive shaft; and wherein said tensioning shaft and said drive shaft are mounted to said housing so as to have respective axes of rotation which are nonparallel to one another.

2. A tensioning device as defined in claim 1, wherein said drive lever includes a roller having an axis of rotation which is fixed to said drive lever and extends parallel to the axis of rotation of said drive shaft, said roller being disposed to cooperate with said camming track.

3. A tensioning device as defined in claim 2 wherein there are a plurality of said clutches, and a plurality of said drive levers, each of said drive levers engaging a respective clutch.

4. A tensioning device as defined in claim 3 wherein said camming track is composed of a plurality of identically shaped camming sections regularly distributed around said cam member for imparting, during each rotation of said tensioning shaft, a number of step-wise rotational advances to said drive shaft equal to the number of said camming sections.

5. A tensioning device as defined in claim 3 wherein said camming track has one upper dead center point and one lower dead center point, said points being spaced 180° apart around the circumference of said cam member, said plurality of drive levers each having a roller mounted thereon, said rollers contacting said camming track at locations spaced 180° apart around the circumference of said cam member.

6. A tensioning device as defined in claim 1 wherein said drive lever has an effective lever arm having a length at least approximately equal to the distance between the axes of rotation of said shafts, and said camming track has a height variation, parallel to the axis of rotation of said tensioning shaft, which determines the magnitude of each step-wise advance of said drive shaft.

7. A tensioning device as defined in claim 1 wherein said camming track is disposed around the circumference of said cam member and has a varying distance from the axis of rotation of said tensioning shaft, and said drive lever includes a roller having an axis of rotation fixed to said drive lever and extending perpendicular to the axis of said drive shaft, said roller being disposed to cooperate with said camming track.

8. A tensioning device as defined in claim 7 wherein said roller has a crowned circumferential surface contacting said camming track.

9. A tensioning device as defined in claim 1 wherein and camming track has a gradually sloping portion which effects movement of said drive lever in the direction to advance said drive shaft and a steep portion which effects movement of said drive lever in the opposite direction, and said gradually sloping portion extends over substantially more than one-half of said camming track.

10. A tensioning device as defined in claim 1 wherein said cam member is a crowned disc which constitutes said camming track and is eccentric to the axis of rotation of said tensioning shaft and said drive lever includes a slot member in which said disc is guided.

11. A tensioning device as defined in claim 10 wherein said crowned disc has a the form of portion of a sphere.

12. A tensioning device as defined in claim 7 wherein said drive lever further comprises a roller bearing disposed between said roller and a portion of said drive lever.

13. A tensioning device as defined in claim 1 wherein said shafts are oriented relative to one another such that there is a plane containing the axis of rotation of one of said shafts and extending perpendicular to the axis of rotation of the other of said shafts.

14. A tensioning device as defined in claim 1 wherein said means for rotating said tensioning shaft comprise a motor having an axis of rotation, parallel to that of said tensioning shaft and gear means coupling said motor to said tensioning shaft, and said tensioning shaft is provided at one end with means for attachment of a hand crank.

15. Tensioning device for a driving spring of an energy store for an a electrical switch, said device comprising:

a housing;

a drive shaft rotatably mounted to said housing and carrying a crank articulated to the driving spring;

a tensioning shaft rotatably mounted to said housing;

means connected for rotating said tensioning shaft;

an overrunning clutch coupled to said drive shaft;

transmission means connected between said tensioning shaft and said overrunning clutch for imparting at least one unidirectional step-wise rotational advance to said drive shaft with each revolution of said tensioning shaft, said transmission means imparting rotation to said drive shaft through said clutch, said transmission means comprising an articulated drive mechanism including a crank pin connected to said tensioning shaft and a follower member including an articulated member having a groove and a drive lever connected to said overrunning clutch, said crank pin being disposed in said groove, whereby rotation of said crank pin oscillates said drive lever for moving said overrunning clutch thereby imparting unidirectional step-wise rotation to said drive shaft; and wherein said tensioning shaft and said drive shaft are mounted to said housing so as to have respective axes of rotation which are nonparallel to one another.

16. A tension device as defined in claim 15, wherein said drive shaft includes a rotational axis and said groove in said articulated member extends parallel to said rotational axis of said drive shaft.

17. A tensioning device as defined in claim 15, wherein said shafts are oriented relative to one another such that there is a plane containing the axis of rotation of one of said shafts and extending perpendicular to the axis of rotation of the other of said shafts.

18. A tensioning device as defined in claim 15, wherein said means for rotating said tensioning shaft comprise a motor having an axis of rotation parallel to that of said tensioning shaft and gear means coupling said motor to said tensioning shaft, and said tensioning shaft is provided at one end with means for attachment of a hand crank.

* * * * *